US010773223B2

(12) United States Patent
Bonnier et al.

(10) Patent No.: US 10,773,223 B2
(45) Date of Patent: Sep. 15, 2020

(54) DEVICE FOR DISPERSING A WATER-SOLUBLE POLYMER

(71) Applicant: S.P.C.M. SA, Andrezieux Boutheon (FR)

(72) Inventors: Julien Bonnier, Saint Etienne (FR); Emmanuel Pich, Saint Priest en Jarez (FR)

(73) Assignee: S.P.C.M. SA (FR)

( * ) Notice: Subject to any disclaimer, the term of this patent is extended or adjusted under 35 U.S.C. 154(b) by 0 days.

(21) Appl. No.: 16/524,959

(22) Filed: Jul. 29, 2019

(65) Prior Publication Data

US 2019/0344228 A1 Nov. 14, 2019

Related U.S. Application Data

(63) Continuation-in-part of application No. 15/560,941, filed as application No. PCT/EP2016/056807 on Mar. 29, 2016, now abandoned.

(30) Foreign Application Priority Data

Apr. 2, 2015 (EP) ..... 15162482

(51) Int. Cl.
*B01F 7/00* (2006.01)
*B01F 1/00* (2006.01)
(Continued)

(52) U.S. Cl.
CPC ..... *B01F 7/00816* (2013.01); *B01F 1/0011* (2013.01); *B01F 7/00825* (2013.01);
(Continued)

(58) Field of Classification Search
CPC ..... B01F 2215/0081; B01F 2215/0422; B01F 3/1221; B01F 7/1635; B01F 7/164; C09K 8/588
See application file for complete search history.

(56) References Cited

U.S. PATENT DOCUMENTS 1,816,562 A * 7/1931 Beers ..... B01F 7/164 159/4.2
2,205,090 A * 6/1940 Gard ..... B01F 3/04539 261/36.1
(Continued)

FOREIGN PATENT DOCUMENTS

WO WO-2011107683 A1 * 9/2011 ..... C22C 38/001
WO WO2011107683 A1 9/2011

*Primary Examiner* — Tony G Soohoo
(74) *Attorney, Agent, or Firm* — Forge IP, PLLC

(57) ABSTRACT

A device for dispersing a water-soluble polymer includes a primary water inlet circuit that feeds an overflow, at the bottom end of the cone, an assembly including a chamber for grinding and draining the dispersed polymer, having a rotor driven by a motor provided with knives, a stator, over all or part of the periphery of the chamber, a ring fed by a secondary water circuit, the ring communicating with the chamber by way of slots for spraying pressurized water onto the stator The slots of the stator and/or the knives of the rotor are tilted at an angle of between 20° and 80° relative to the horizontal plane of the stator and the lateral face of the blade next to the stator is curved in such a way as to make the distance separating the two components substantially constant.

14 Claims, 4 Drawing Sheets

(51) Int. Cl.
*B01F 13/10* (2006.01)
*B02C 18/08* (2006.01)
*B02C 18/18* (2006.01)

(52) U.S. Cl.
CPC ..... *B01F 13/1041* (2013.01); *B02C 18/086* (2013.01); *B02C 18/18* (2013.01); *B01F 2013/1086* (2013.01); *B01F 2215/0081* (2013.01); *B01F 2215/0422* (2013.01); *B01F 2215/0427* (2013.01); *B01F 2215/0431* (2013.01)

(56) References Cited

U.S. PATENT DOCUMENTS 2,541,221 A * 2/1951 Edwards ..... B01F 7/164 239/133
2,706,621 A * 4/1955 Laird ..... B01F 7/164 241/275
2,882,149 A * 4/1959 Willems ..... B01F 7/164 241/157
3,125,305 A * 3/1964 Willems ..... B01F 7/00766 241/162
3,194,540 A * 7/1965 Hager ..... A01J 11/16 241/259.1
3,195,867 A * 7/1965 Mould, Jr. ..... B01F 7/00758 241/244
3,229,965 A * 1/1966 Hill ..... B01F 15/00012 366/270
4,333,834 A * 6/1982 Werner ..... B01F 3/04617 210/219
4,529,794 A * 7/1985 Sortwell ..... B01F 1/0011 528/499
4,640,622 A * 2/1987 Sortwell ..... B01F 5/248 366/156.1
4,845,192 A * 7/1989 Sortwell ..... B01F 1/0011 528/499
4,874,588 A * 10/1989 Sortwell ..... B01F 1/0022 422/269
5,096,690 A * 3/1992 Saito ..... B01F 7/164 422/209
5,156,344 A * 10/1992 Tippett ..... B01F 7/164 241/199.12
5,575,559 A * 11/1996 Roll ..... B01F 7/0075 366/171.1
5,632,596 A * 5/1997 Ross ..... B01F 7/00758 241/261
6,000,840 A * 12/1999 Paterson ..... B01F 7/164 241/46.11
6,854,878 B2 * 2/2005 Jacob ..... B01F 3/1221 366/304
8,146,843 B2 * 4/2012 Ye ..... E03C 1/2665 241/46.013
9,452,395 B2 * 9/2016 Jeronimo ..... B01F 1/0011
9,574,334 B2 * 2/2017 Gormley ..... E03C 1/2665
10,137,420 B2 * 11/2018 Luharuka ..... B01F 3/1221
2015/0238913 A1 * 8/2015 Luharuka ..... B01F 5/106 366/138
2015/0352507 A1 * 12/2015 Jeronimo ..... B01F 1/0011 241/41
2016/0002900 A1 * 1/2016 Gormley ..... E03C 1/2665 241/46.013

* cited by examiner

DEVICE FOR DISPERSING A WATER-SOLUBLE POLYMER

FIELD OF INVENTION

A device for dispersing a water-soluble polymer comprising a wetting cone connected to a column metering the polymer of standard particle size.

BACKGROUND OF THE INVENTION

Polyacrylamides are being used in increasing quantities in enhanced oil recovery (EOR).

Large facilities for dissolving polyacrylamides have treated tens of kilograms per hour until recently. The problem of initially wetting the powder, which tends to agglomerate a great deal, has been solved using simple methods (ejectors, wetting shovels, nozzles within a tube, etc.). These methods facilitate low flow rates at low concentrations (0.5%) and long dissolving times (1 hour for standard powders with a particle size less than 1 mm).

The document WO 2011/107683 describes a device (PSU or Polymer Slicing Unit) that both grinds and disperses the powder in the dissolving water (solution water). This apparatus is composed of a rotor with sharp blades and a stator with thin slots. Depending on the thickness of these slots, the powder is more or less ground finely. Dissolving is almost instantaneous with slots of 200μ but the flow rate is low. Slots of approximately 700 microns reduce the dissolving time to 30 minutes and obtain very high concentrations in the order of 20 gr/liter. These concentrations greatly reduce the size of the dissolving tanks and metering pumps which has the advantage of a significant reduction in the corresponding financial investment.

The stator of this apparatus has slots that are cut by a fine jet of very high-pressure water (200 MPa (2000 bar)) or by using a laser.

The disadvantage of this type of stator is that it gives rise to vibrations inside the apparatus that lead to premature bearing wear. This wear has consequences for the functioning of the apparatus and the ability thereof to dissolve large quantities of polymer.

SUMMARY OF THE INVENTION

The purpose of this invention is to provide an apparatus wherein the vibrations are reduced. A further aim is to disperse even greater quantities of water-soluble polymer within a shorter period of time.

In order to reduce these harmful vibrations, the applicant found it necessary for the slots of the stator and/or the blades of the rotor to be tilted at an angle between 20° and 80° relative to the horizontal plane of the stator.

The horizontal plane of the stator also corresponds to the horizontal plane of the rotor.

In other words, the subject of the invention is a device for dispersing a water-soluble polymer with a particle size of less than 1.5 mm, comprising:

- a wetting cone wherein the polymer is metered, said cone being connected to a primary water inlet circuit
- at the bottom end of the cone:
  - a chamber for grinding and draining the dispersed polymer including:
    - a rotor driven by a motor and provided with blades,
    - a fixed stator comprising slots with an advantageous width of 50 to 1200 microns,
    - over all or part of the periphery of the chamber, a ring fed by a secondary water circuit and the ring communicating with the chamber in such a way as to guarantee the spraying of pressurized water onto the stator.

The device is characterized by the slots of the stator and/or the knives of the rotor being tilted at an angle of between 20° and 80° relative to the horizontal plane of the stator.

The angle between the blades of the rotor and/or the stator slots in relation to the horizontal plane in a preferred embodiment is at least 30°. This angle is less than 70°, preferably less than 60°. This angle is preferably between 30° and 70°, more preferably between 40° and 60°.

The tilted slots are made by cutting the slots in the stator diagonally according to the cutting technique using a very high-pressure jet of water or a laser. The blades are tilted by tilting the blades of the rotor by means of specific machining.

The slots are preferably rectilinear and parallel to one another.

The slots in a particular embodiment of the invention combine a succession of curves, possibly separated by rectilinear portions. In this case, the angle is calculated between the straight line connecting the two ends of the slot in relation to the horizontal plane of the stator.

In a preferred embodiment, when the slots and the blades are tilted, the two inclinations are opposite, advantageously in a symmetrical manner. More precisely, if the slots are tilted on one side in relation to the horizontal plane of the stator, then the blades are tilted on the other side. Advantageously, the angle formed by the blades and the slots in relation to horizontal plane is the same.

The slots of the stator in a preferred embodiment are tilted and the rotor blades are perpendicular to the horizontal plane of the stator.

The stator has the form of a cylinder wherein, within the wall thereof, slots are cut into part of the height of said wall, the slots having a width of between 50 and 1200 microns. Preferably the wall of the stator has a thickness of between 5 mm and 30 mm, and more preferably between 10 and 20 mm. The height of the stator is preferably between 10 mm and 150 mm and more preferably between 20 and 100 mm. The diameter of the stator is preferably between 100 and 500 mm.

The number of slots in the stator is preferably between 20 and 1500, advantageously from 50 to 1500, and more preferably between 50 and 1000.

In a preferred embodiment, the slots in the stator are regularly spaced apart at a distance of between 1 and 50 mm. They are preferably parallel between each other.

The slots generally have a length of between 10 mm and 100 mm, although it is possible to have longer slots. In the case of slots of a greater length than 25 mm, it is possible to cut them into 2, 3, or 4 parts, preferably of equal length.

In a specific embodiment, the inner walls of the slots are tilted in such a way as to create sharp edges on each slot.

The distance separating the free end of the rotor blades and the stator slots is between 50 and 300 microns, preferably between 100 and 200 microns, in practice on the order of 100 microns. When the blades are tilted and the lateral face thereof facing the stator wall is flat, the distance separating the free end of the blades from the stator slots varies. This is due to the fact that a flat surface (that of the blades) and a rounded surface (that of the stator) come into contact with one another. In fact, the distance between the free end of a blade and the stator is lower at the high and low ends of the blade, whilst it is greater at the center. In all cases, it is between 50 and 300 microns. In a specific embodiment, the side of the blade against the wall of the stator is bent in the same direction as the curve of the stator. In so doing, the difference in distance between the blades and the slots is limited or even canceled.

Similarly, the inclined face of each blade connecting the center of the rotor to the periphery is of a generally rounded shape. Such a configuration makes it possible to drain the polymer more easily. In a specific embodiment, each blade has a front face (in the way of rotation of the rotor) and a rear face and at least the front face, advantageously both faces, have a generally rounded shape. Advantageously, starting from the center to the periphery of the rotor, the front face of each blade has a first portion having a first bend radius and a second portion having a second bend radius which is longer that the first one and the rear face of the blade has a constant bend radius which is identical to the one of the second portion. In another embodiment, starting from the center to the periphery of the rotor, the upper side of each blade has a first portion having a first height and a second portion having a second height, the second height being less than the first height. Advantageously, the rotor has 9 blades.

In a preferred embodiment, the rotor blades, at least in part, and the stator are made of a stainless steel chosen from austeno-ferritic or austenitic steels treated by vacuum nitriding or by the diffusion of carbon under vacuum.

The stator is cut by means of cutting using a very high-pressure jet of water containing an abrasive at a pressure of between 200 and 500 MPa (between 2000 and 5000 bar), preferably between 200 and 300 MPa (between 2,000 and 3,000 bars).

The rotor constitutes:

- either a support at the surface of which blades are shaped by means of milling. In this case, the rotor is manufactured in the entirety thereof from one of the aforementioned materials;
- or a support at the surface of which there are blades, the blades being composed of a plate upon which a blade made of tungsten carbide is implemented.

The rotor is equipped with 2 to 20 blades, preferably between 4 and 12. However, depending upon the diameter of the rotor, the number of blades may vary. For example, it is 9 for a rotor 200 mm in diameter.

Moreover, and according to another characteristic, the blades are possibly more or less offset in relation to the radius of the rotor. Advantageously, this offset is between 1 and 15°, preferably between 2 and 10°.

According to a particular embodiment of the invention, the wetting cone is arranged in a vertical manner and the grinding chamber is arranged in a vertical manner, each being connected together by means of a conduit in the form of an elbow at an angle of 90°. This configuration is particularly suitable when the device is relatively large.

The invention and resulting benefits will become clear from the following examples supported by the attached figures.

DETAILED DESCRIPTION OF THE INVENTION

Figure 1:
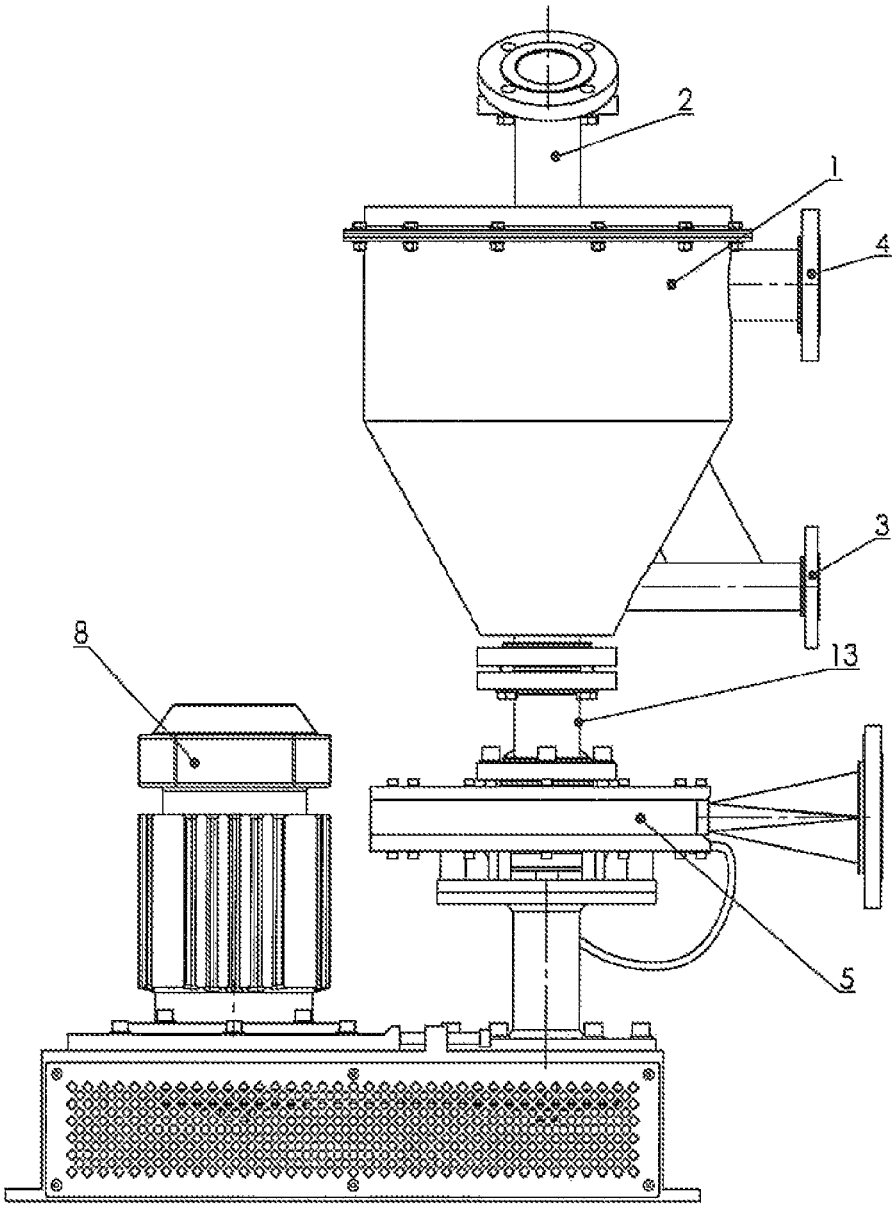
FIG. 1 is a schematic side view of the device of the invention.
Figure 2:
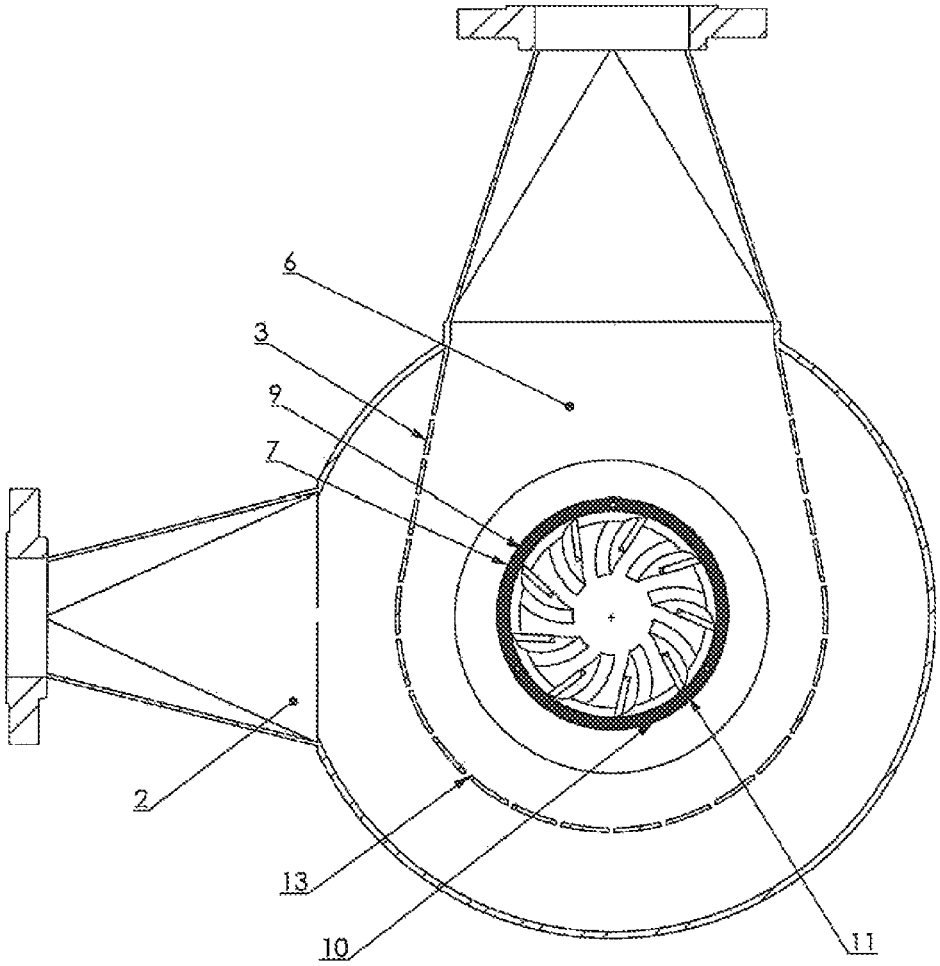
FIG. 2 is a sectional view taken along the line AA'.

According to FIG. 1, the device of the invention is composed of:

- a wetting cone (1) connected at the top of same to a column (2) metering the polymer of standard particle size, most usually by means of a metering screw, the bottom part of the cone (1) being connected to a primary water inlet circuit (3) that feeds an overflow (4),
- at the bottom end of the cone, an assembly (5) composed of:
  - a chamber (6) for grinding and draining (FIG. 2) the dispersed polymer, composed of:
    - a rotor (7) driven by a motor (8) provided with blades (9),
    - a stator (10),
  - over all or part of the periphery of the chamber, a ring (11) fed by a secondary water circuit (12), the ring (11) communicating with the chamber (6) by means of slots (13) for spraying pressurized water onto the stator (10).

Figure 3:
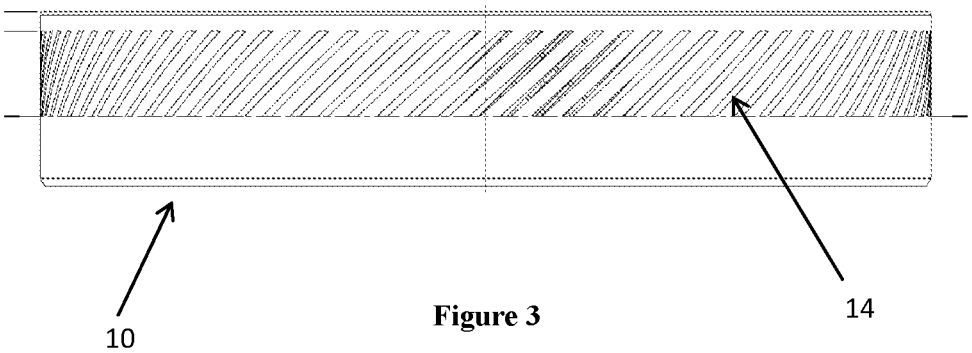
FIG. 3 is a schematic side view of the stator of the device of the invention wherein the slots are tilted in relation to the horizontal plane of the stator.
Figure 4:
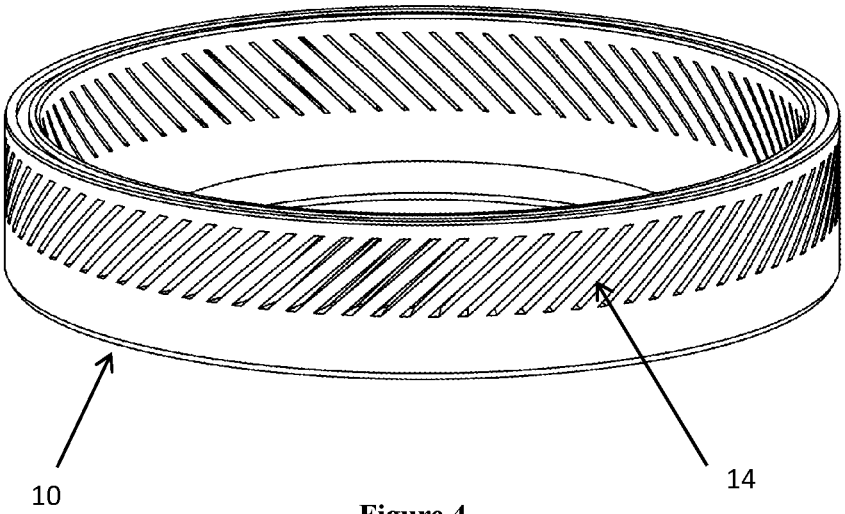
FIG. 4 is a schematic three-dimensional view of the stator of the device of the invention wherein the slots are tilted in relation to the horizontal plane of the stator.

According to FIGS. 3 and 4, the slots (14) of the stator (10) are tilted in relation to the horizontal plane of the device. The dimensional characteristics of the stator are reported in the table below.

Figure 5:
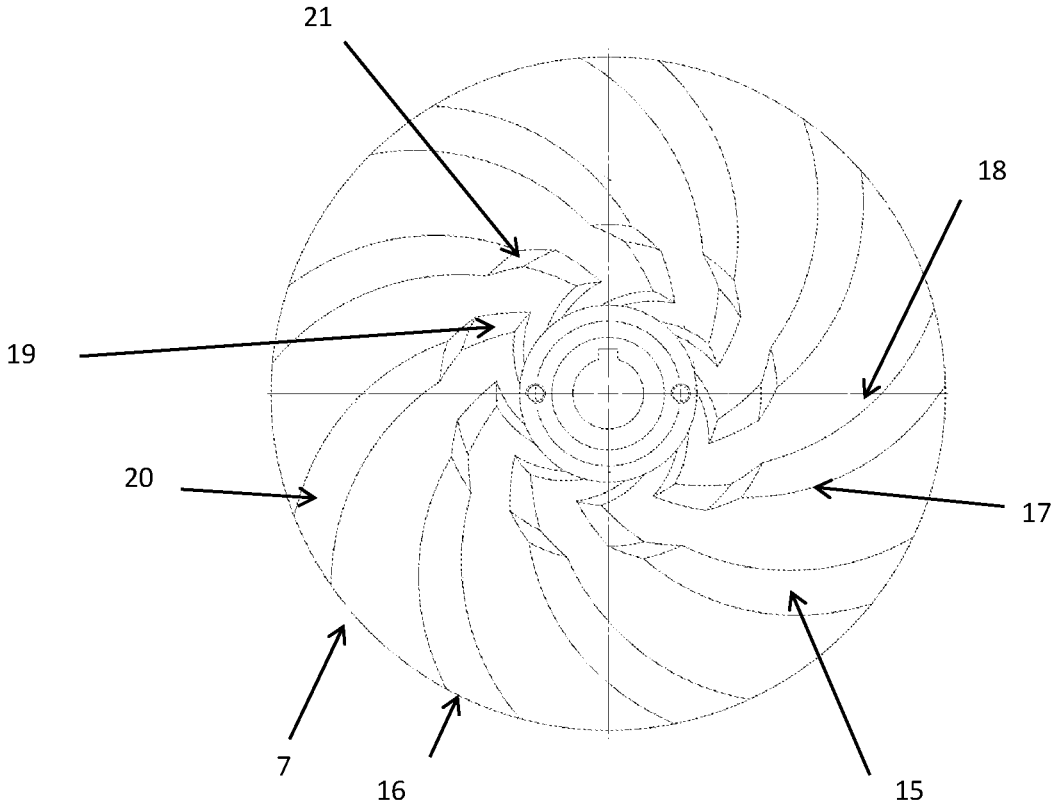
FIG. 5 is a top view of the rotor of the device of the invention wherein the blades are tilted in relation to the horizontal plane of the stator.
Figure 6:
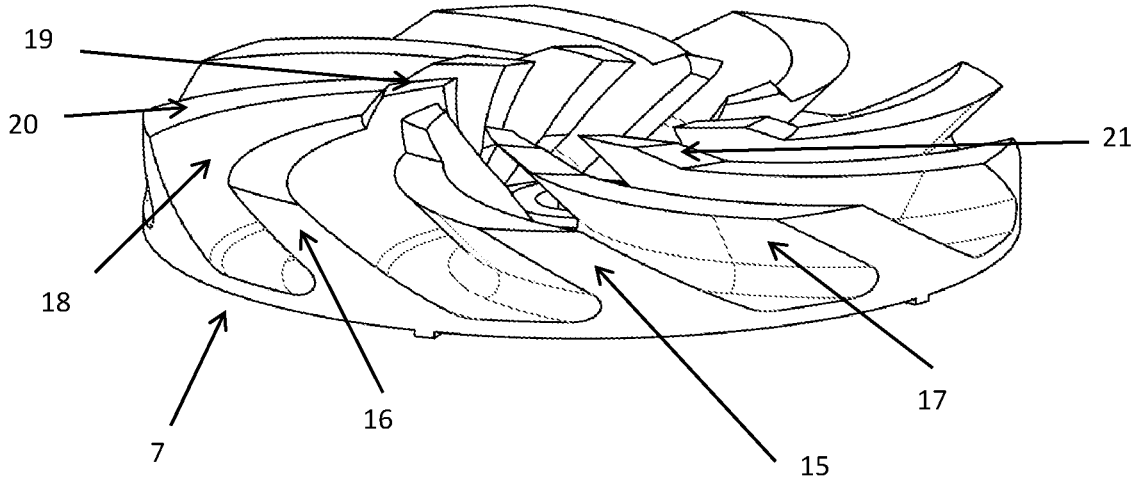
FIG. 6 is a three-dimensional view of the rotor of the device of the invention wherein the blades are tilted in relation to the horizontal plane of the stator.

According to FIGS. 5 and 6, the blades (15) of the rotor (7) are tilted in relation to the horizontal plane of the device. As these figures show, the lateral face (16) of the blade next to the stator is curved in such a way as to make the distance separating the two components substantially constant. Similarly, the inclined face (front face 17 and rear face 18) of each blade connecting the center of the rotor to the periphery is of a generally rounded shape. Starting from the center to the periphery of the rotor, the front face (17) of each blade has a first portion having a first bend radius between 30 and 50 mm and a second portion having a second bend radius between 55 and 70 mm and the rear face (18) of the blade has a constant bend radius which is identical to the one of the second portion. Additionally, the upper side of each blade has a first flat portion (19) having a first height between 35 and 40 mm and a second flat portion (20) having a second height between 30 and 34.5 mm, both portions being separated by a titled portion (21) forming an angle with the second flat portion of between 130 and 140°. As illustrated, the rotor has 9 blades.

A device according to the invention wherein the slots are tilted at 45° to the horizontal plane of the stator and wherein the blades are perpendicular to the horizontal plane of the stator is compared to the device according to the example in the document WO 2011/107683 wherein the slots and the blades are perpendicular to the horizontal plane of the stator.

The vibrations of the apparatus in operation were measured using a PCE-VT 1000 vibration meter. The vibrations are expressed in mm/s. The lower the value, the lower the vibrations. Values lower than 1 are typical of a good result in terms of vibration. However, values below 1.8 are acceptable.

The results are reported in the following table.

| | PSU 300 according to document WO 2011/107683 | PSU 300 according to the Invention |
|---|---|---|
| Cutting diameter (mm) | 200 | 200 |
| Number of slots | 110 | 110 |
| Height of the slots (mm) | 16.6 | 16.6 |
| Width of the slots (microns) | 200 | 200 |
| Inclination of the slots in relation to the horizontal plane | 0° | 45° |
| Number of blades (rotor) | 9 | 9 |
| Motor power (kW) | 7.5 | 7.5 |
| Rotor speed [rpm] | 4500 | 4500 |
| Vibration (mm/s) | 2.8 | 0.46 |
| Maximum primary water flow rate ($m^3$/h) | 15 | 17 |
| Secondary water flow rate ($m^3$/h) | 20 | 23 |
| Powder flow rate (continuous mode) kg/h | 300 | 450 |

The 45° inclination of the slots within the device according to the invention allows for a significant reduction in vibration from 2.8 mm/s to 0.45 mm/s, an 84% decrease in vibration. The life expectancy of the bearings is therefore greatly increased.

It is also apparent that this makes it possible to increase the rate at which polyacrylamide powder dissolves from 300 kg/h to 450 kg/h in continuous mode, i.e., when the apparatus functions continuously for a long period of several days or several weeks.

When necessary this flow rate may occasionally be increased to a so-called "maximum" flow rate for a short period.

The apparatus according to the invention increases the flow rate of the polymer solution up to 40 $m^3$/h and a maximum powder quantity of 550 kg/h can be reached without blocking the apparatus.

Other devices wherein the slots are inclined at 10°, 30°, 60°, and 80° in relation to the horizontal plane of the stator have been tested, the blades remaining not-inclined. The vibration values measured were respectively 2.5 mm/s, 0.8 mm/s, 0.9 mm/s, and 1.6 mm/s.

A significant reduction in vibration is observed when the inclination angle of the slots in relation to the horizontal plane of the stator is greater than 20°. Better results are obtained for angles between 30 and 70°.

This solution of inclining only the slots of the stator is the simplest from the point of view of machining. However, a rotor with angled blades was also tested giving similar vibration and flow rate results.

The invention claimed is:

1. A device for dispersing a water-soluble polymer with a particle size of less than 1.5 mm, said device comprising:

a wetting cone wherein the polymer is metered, said cone being connected to a primary water inlet circuit at the bottom end of the cone:

a chamber for grinding and draining the dispersed polymer including:

a rotor driven by a motor and provided with a center, a periphery and blades having a rear face and a front face, a fixed stator having the form of a cylinder including slots, over all or part of the periphery of the chamber, a ring fed by a secondary water circuit, the ring communicating with the chamber in such a way as to guarantee the spraying of pressurized water onto the stator, wherein the slots of the stator and/or the blades of the rotor are tilted at an angle between 20° and 80° relative to a horizontal plane of the stator and the lateral face of the blade next to the stator is curved in such a way as to make the distance separating the two components substantially constant, wherein an upper side of each blade has a first portion having a first height and a second portion having a second height, the second height being less than the first height, and wherein the first height is between 35 and 40 mm and the second height is between 30 and 34.5 mm, both portions being separated by a tilted portion forming an angle with the second portion of between 130 and 140°.

2. The device according to claim 1, wherein the front face of each blade connecting the center of the rotor to the periphery is of a generally rounded shape.

3. The device according to claim 1, wherein the front face and the rear face of each blade connecting the center of the rotor to the periphery is of a generally rounded shape.

4. The device according to claim 1, wherein the front face of each blade has a first portion having a first bend radius and a second portion having a second bend radius which is longer that the first bend radius and the rear face of the blade has a constant bend radius which is identical to the bend radius of the second portion.

5. The device according to claim 4, wherein the first bend radius is between 30 and 50 mm and the second bend radius is between 55 and 70 mm.

6. The device according to claim 1, wherein the blades are offset in relation to a radius of the rotor at an angle between 1 and 15°.

7. The device according to claim 6, wherein the blades are offset in relation to the radius of the rotor at an angle between 2 and 10°.

8. The device according to claim 1, wherein the slots of the stator and the blades of the rotor are tilted at an angle of between 30° and 70° relative to the horizontal plane of the stator.

9. The device according to claim 1, wherein the slots of the stator and the blades of the rotor are tilted at an angle of between 40° and 60° relative to the horizontal plane of the stator.

10. The device according to claim 1, wherein the slots are rectilinear and parallel to one another.

11. The device according to claim 1, wherein the slots and the blades are tilted at two inclinations and the two inclinations are symmetrically opposed.

12. The device according to claim 1, wherein slots of the stator are cut into part of a height of said cylinder.

13. The device according to claim 1, wherein:

the slots in the stator have a width of between 50 and 1200 microns, the stator cylinder has a thickness of between 5 and 30 mm, a height of the stator is between 20 and 100 mm a diameter of the stator is between 100 and 500 mm a number of stator slots is between 50 and 1500, the slots in the stator are regularly spaced apart at a distance of between 1 and 50 mm, the slots have a length of between 10 mm and 100 mm.

14. The device according to claim 1, wherein a distance separating a free end of the rotor blades and the stator slots is between 50 and 300 microns.

* * * * *